US009534836B2

(12) United States Patent
Dubettier-Grenier et al.

(10) Patent No.: US 9,534,836 B2
(45) Date of Patent: Jan. 3, 2017

(54) AIR SEPARATION PLANT AND PROCESS OPERATING BY CRYOGENIC DISTILLATION

(75) Inventors: Richard Dubettier-Grenier, Houston, TX (US); Alain Guillard, Houston, TX (US)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 837 days.

(21) Appl. No.: 13/703,821

(22) PCT Filed: Jun. 17, 2011

(86) PCT No.: PCT/EP2011/002996

§ 371 (c)(1),
(2), (4) Date: Dec. 12, 2012

(87) PCT Pub. No.: WO2011/157431

PCT Pub. Date: Dec. 22, 2011

(65) Prior Publication Data

US 2013/0086940 A1 Apr. 11, 2013

(30) Foreign Application Priority Data

Jun. 18, 2010 (FR) ..... 10 54837

(51) Int. Cl.
*F25J 3/00* (2006.01)
*F25J 3/04* (2006.01)

(52) U.S. Cl.
CPC ..... *F25J 3/00* (2013.01); *F25J 3/0409* (2013.01); *F25J 3/04018* (2013.01); *F25J 3/04121* (2013.01); *F25J 3/04133* (2013.01); *F25J 3/04169* (2013.01); *F25J 3/04206* (2013.01); *F25J 3/04418* (2013.01); *F25J 3/04781* (2013.01); *F25J 3/04812* (2013.01); *F25J 3/04824* (2013.01); *F25J 3/04957* (2013.01); *F25J 2200/54* (2013.01); *F25J 2205/62* (2013.01); *F25J 2230/24* (2013.01); *F25J 2230/40* (2013.01); *F25J 2240/42* (2013.01); *F25J 2245/40* (2013.01); *F25J 2250/40* (2013.01); *F25J 2250/50* (2013.01)

(58) Field of Classification Search
CPC .... F25J 3/0403; F25J 3/04084; F25J 3/04812; F25J 3/04036; F25J 3/0409; F25J 3/04296; F25J 3/04781; F25J 3/04218; F25J 2230/24; F25J 2230/02; F25J 2280/02
See application file for complete search history.

(56) References Cited

U.S. PATENT DOCUMENTS 3,731,495 A 5/1973 Coveney
3,754,406 A * 8/1973 Allam ..... 62/646
(Continued)

FOREIGN PATENT DOCUMENTS

| | | |
|---|---|---|
| EP | 0717249 A2 | 6/1996 |
| EP | 0773416 A2 | 5/1997 |
| EP | 0992275 A1 | 4/2000 |
| EP | 1223396 A1 | 7/2002 |
| FR | 2853958 A1 | 10/2004 |
| FR | 2895068 | 6/2007 |

OTHER PUBLICATIONS

PCT/EP2011/002996; International Search Report and Written Opinion; Jul. 10, 2013.
FR1054837; Search Report and Written Opinion; Mar. 1, 2011.

*Primary Examiner* — Frantz Jules
*Assistant Examiner* — Brian King
(74) *Attorney, Agent, or Firm* — Justin K. Murray

(57) ABSTRACT

An air separation plant is provided that includes a plurality of air compressors, a plurality of air purification units, and one or more cold boxes. In a first mode of operation, a first air compressor is configured to compress air to a higher pressure than a second air compressor. In a second mode of operation, the second air compressor is configured to compress air to a higher pressure than during the first mode of operation.

18 Claims, 1 Drawing Sheet

(56) References Cited

U.S. PATENT DOCUMENTS

| | | | | | |
|---|---|---|---|---|---|
| 4,356,013 | A * | 10/1982 | Linde | F25J 3/04212 | 62/646 |
| 4,595,405 | A * | 6/1986 | Agrawal | F25J 3/042 | 62/646 |
| 5,082,482 | A * | 1/1992 | Darredeau | | 62/646 |
| 5,337,570 | A * | 8/1994 | Prosser | F25J 3/0409 | 62/646 |
| 5,496,388 | A * | 3/1996 | Tellier | B01D 53/22 | 96/111 |
| 5,609,041 | A * | 3/1997 | Rathbone et al. | | 62/646 |
| 2002/0170313 | A1* | 11/2002 | Zapp et al. | | 62/643 |
| 2007/0186582 | A1* | 8/2007 | Guillard | | 62/648 |
| 2008/0223077 | A1* | 9/2008 | Prosser et al. | | 62/646 |

* cited by examiner

AIR SEPARATION PLANT AND PROCESS OPERATING BY CRYOGENIC DISTILLATION

CROSS REFERENCE TO RELATED APPLICATIONS

This application is a §371 of International PCT Application PCT/EP2011/002996, filed Jun. 17, 2011, which further claims the benefit of FR 1054837, filed Jun. 18, 2010, both of which are herein incorporated by reference in their entireties.

TECHNICAL FIELD OF THE INVENTION

The present invention relates to an air separation plant and process operating by cryogenic distillation.

BACKGROUND

In an air separation plant comprising one or more series of air compressors and one or more cold boxes, the air compressors have fixed functions which do not vary in accordance with the operating modes of the plant. In particular, an air compressor compresses the air from atmospheric pressure up to a delivery pressure substantially the same as that of the distillation column having the highest pressure. A booster compressor compresses air from this delivery pressure of the air compressor to a delivery pressure defined by a combination of the pressure for vaporization of the oxygen and/or the liquid nitrogen and the quantity of liquid products to be produced.

FR-A-2895068 describes an air separation plant comprising two air compressors receiving air at a pressure substantially equal to atmospheric pressure, two air purification units and two cold boxes. Each compressor is connected to each of the purification units so as to send compressed air thereto, the purification units being each connected to two cold boxes. A first of the compressors is designed to produce air at a first pressure and send the air at the first pressure to a first purification unit and the first purification unit is connected to high-pressure air lines of a first cold box. A second compressor is designed to produce air at a second pressure, lower than the first pressure, and send the air at the second pressure to a second purification unit and the second purification unit is connected to medium-pressure air lines of the second cold box.

With this process it is not possible to continue operation of an air separation apparatus supplied with the purified high-pressure air when the only compressor supplying high-pressure air during normal operation and/or the only purification unit supplying purified high-pressure air during normal operation produces less air than expected or is not in working order.

SUMMARY OF THE INVENTION

An aim of the invention is to overcome the drawbacks of the known processes. In particular with the process according to the invention it is possible to:

- reduce the number of machines: while the number of main compressors remains the same, there are no more air booster compressors;
- reduce the size of the purification units by purifying the air at the highest possible pressure;

- maximize the recovery of the compression heat (usually the low temperature heat of the booster compressor cannot be recovered).

According to an object of the invention an air separation plant is envisaged, said plant comprising at least two air compressors receiving air at substantially atmospheric pressure, at least two air purification units and one or more cold boxes, at least one compressor being connected to each of the purification units so as to send compressed air thereto, the purification units being connected to the cold box or boxes, a first compressor being designed to produce air at a first pressure and to send all the air at the first pressure to a first purification unit, the first purification unit being connected to one or more high-pressure air lines of the cold box or a first cold box, a second compressor being designed to produce air at a second pressure and to send all the air at the second pressure to a second purification unit, and the second purification unit being connected to one or more medium-pressure air lines of the cold box or first cold box, characterized in that it comprises a means for modifying the operation of the second compressor in order to increase the pressure of the air produced to a pressure higher than the second pressure, and preferably the same as the first pressure, the second pressure being lower than the first pressure, and the delivery side of the second compressor being connected to the high-pressure air line or lines of the cold box or first cold box through the second purification unit so as to send air thereto at the pressure higher than the second pressure.

Optionally:

- at least one of the compressors has two axial stages;
- the means for modifying operation of the second compressor consist of a device coupled to the second compressor designed to have a variable speed of rotation;
- the device is a steam turbine or a high-speed motor;
- the plant does not have any air compressor driven by a steam turbine or electric motor with an intake pressure substantially higher than atmospheric pressure;
- the number of compressors is a multiple of 3 and/or the number of purification units is a multiple of 3 and/or the number of cold boxes is a multiple of 2;
- the plant does not comprise compression means downstream of the first compressor and upstream of the cold box or first cold box and/or not comprising compression means downstream of the second compressor and upstream of the cold box or first cold box;
- the delivery side of the first compressor is connected solely to the inlet of the first purification unit;
- the delivery side of the first compressor is connected solely to the inlet of the second purification unit.

According to another object of the invention, an air separation process is envisaged, said process using at least two air compressors supplied by air at atmospheric pressure, at least two air purification units and at least one air separation cold box wherein, according to a first operating mode, high-pressure air is sent from a first compressor to a first purification unit and from the first purification unit to the cold box or a first cold box via one or more high-pressure lines and medium-pressure air is sent from a second compressor to the second purification unit and from the second purification unit to the cold box or first cold box and characterized in that, according to a second operating mode, the second compressor is modified so that it produces high-pressure air instead of producing medium-pressure air, the high pressure being higher than the medium pressure, the high-pressure air of the second compressor being purified in the second purification unit and sent to the cold box or first cold box via the high-pressure line or lines, and optionally the first compressor is stopped and/or the first purification unit is stopped.

Optionally:

- the first air compressor produces air between 3.5 bar and 10 bar absolute, preferably between 3.5 and 5 bar absolute, or also between 4 and 5 bar absolute, and the second compressor produces air during the first operating mode at between 2.5 and 5 bar absolute, preferably 3 bar and 4 bar and during the second operating mode at between 3.5 bar and 10 bar absolute, preferably between 3.5 and 5 bar absolute, or else between 4 and 5 bar absolute;
- the first operating mode is the nominal mode, and the second operating mode is an emergency operating mode;
- the first operating mode is the nominal operating mode for production by air separation, and the second operating mode is a reduced operating mode for production by air separation;
- according to the second operating mode, the high-pressure air of the second compressor is sent to the second purification unit at high pressure;
- all the air of the first compressor is sent to the first purification unit and all the air of the second compressor is sent to the second purification unit in the two operating modes.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

Figure 1:
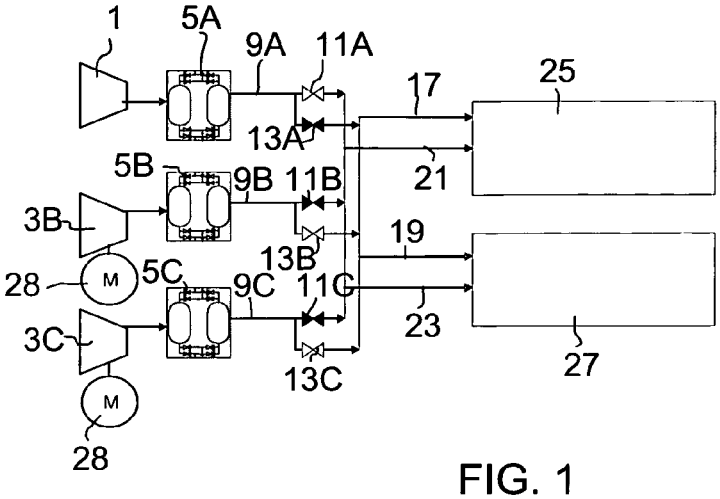
FIG. 1 represents an embodiment in accordance with the present invention.
Figure 2:
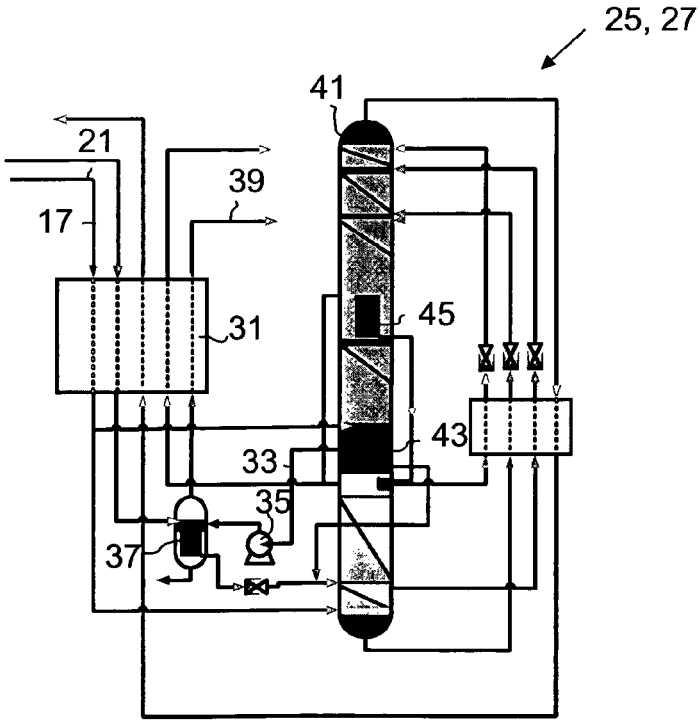
FIG. 2 represents an embodiment in accordance with the present invention.

The invention will be described in greater detail with reference to the figures, in which FIG. 1 shows a plant according to the invention and FIG. 2 shows a typical cold box being able to be incorporated in the plant as an air separation apparatus.

In FIG. 1 it can be seen that there is an air compressor 1 and two air compressors 3B, 3C, all receiving air at atmospheric pressure. It will be noted that there is no air booster compressor receiving air at a pressure higher than atmospheric pressure.

The compressor 1 is connected to an air purification unit 5A and the compressors 3B, 3C are connected to the purification units 5B, 5C in order to supply them with air. The cold boxes 25, 27 each contain the exchangers and the columns of an air separation apparatus. The apparatus is supplied in each case by a high-pressure air line and a medium-pressure air line. The terms "high pressure" and "medium pressure" mean simply that the high pressure is higher than the medium pressure, whereby the difference between the two may be relatively small. The first air compressor 1 produces air at between 3.5 bar and 10 bar absolute, preferably between 3.5 and 5 bar absolute, or else between 4 and 5 bar absolute, and the second compressor produces air at a variable pressure, during the first operating mode at a medium pressure between 2.5 and 5 bar absolute, preferably between 3 bar and 4 bar.

Thus a medium-pressure line 17 and a high-pressure line 21 supply the cold box 25 and a medium-pressure line 19 and a high-pressure line 23 supply the cold box 27. The air in the high-pressure lines must further perform the function of vaporizing the liquid oxygen under pressure of the air separation apparatus.

According to a first operating mode of the apparatus, corresponding for example to the nominal operating mode, the air 9A from the purification unit 5A circulates inside a line connected to the high-pressure line 21 and the high-pressure line 23 in order to supply the cold boxes 25, 27 with high-pressure air. The valve 13A is closed and the valve 11A is open.

The compressors 3B, 3C produce medium-pressure air which is purified in the purification units 5B, 5C. The purified medium-pressure air in the line 9B is sent via the open valve 13B to the medium-pressure lines 17, 19. The purified air in the line 9C is sent via the open valve 13C to the medium-pressure lines 17, 19 and thus the cold boxes 25, 27 are supplied with medium-pressure air, the valves 11B, 11C being closed.

According to a second operating mode of the apparatus, if the compressor 1 is not working, in order to continue producing high-pressure air, operation of the compressor 3B is modified so that it produces high-pressure air instead of producing medium-pressure air. This may be performed by modifying the speed of a steam turbine or a motor 28 driving it. The high-pressure air produced is purified in the purification unit 5B which can withstand processing of such a pressure. Since the valve 13B is closed and the valve 11B is open, the air from the line 9B passes into the high-pressure lines 17, 19 so as to supply the cold boxes 25, 27 with high-pressure air. Optionally a part of the high-pressure air may be returned at a reduced pressure to the medium-pressure air lines 17, 19 (if there is an excess of high-pressure air).

The compressor 3C continues to produce medium-pressure air and sends air to the purification unit 5C. The air purified in the line 9C is sent via the open valve 13C to the medium-pressure lines 17, 19 and thus the cold boxes 25, 27 are supplied with medium-pressure air, the valve 11C being closed.

It would also be possible, even if the figure does not show the required connections, in the event of breakdown of the compressor 1, to send the high-pressure air from the compressor 3B to the purification unit 5A and then to the lines 17, 19 via the valve 13A, the valve 11A being closed. In this case, a lower pressure variation tolerance for the purification unit is required.

The advantage of the arrangement shown in FIG. 1 is that it allows the purification unit 5A to be bypassed in the event of malfunctioning of the unit.

The compressors 1, 3B, 3C may have axial stages. The plant may comprise means for recovering heat downstream of at least one of the compressors 1, 3B, 3C.

In the event of a reduction in the production output or breakdown of one of the compressors 3B, 3C, the air from the compressor 1 may be deviated via the valve 13A which reduces the pressure of the air from the high pressure to the medium pressure so as to send it to the lines 21, 23.

The second operating mode of the apparatus may correspond to a stoppage of the purification unit 5A associated with the compressor 1, a reduction in the flowrate produced by the compressor 1 or the purification unit 5A, or a reduction in the quantity of product(s) which must be produced by the cold boxes 25, 27. For example, in the event of a reduction in the flowrate of the pressurized oxygen to be vaporized together with the high-pressure air, advantageously the compressor 3B may be used instead of the compressor 1 in order to produce the smallest quantity of oxygen required.

Reduced to its simplest configuration, FIG. 1 would comprise only the compressors 1 and 3B, the purification units 5A and 5B and a cold box 25, the cold box 27 and compressor 3C having been eliminated. According to the first operating mode, the compressor 1 would produce high-pressure air to be purified in the purification unit 5A and the compressor 3B would produce medium-pressure air to be purified in the purification unit 5B.

According to the second operating mode, the compressor 1 would be stopped and the compressor 3B would produce high-pressure air, a part of which would be reduced in pressure back down to medium-pressure air via the valve 13B. Thus the compressor 3B would produce the two air pressures required for the cold box 25.

FIG. 2 shows an air separation apparatus such as that which could be installed in at least one of the cold boxes 25, 27. When supplied with the high-pressure air 21 and the medium-pressure air 17 from one of the compressors, the apparatus produces low-pressure oxygen 39 intended for an oxygen combustion unit. The oxygen 33 pumped at a pressure of between 1.2 bar absolute and 2 bar absolute by the pump 35 is vaporized in the dedicated vaporizer 37, where the cold, vaporized oxygen enters heat exchanger 31, thereby cooling medium-pressure air 17 and high-pressure air 21. The apparatus comprises a double column 41 with a medium-pressure column thermally connected to a low-pressure column by means of two reboilers 43, 45. The vessel reboiler 43 is heated by air from the medium-pressure line 17 and the intermediate reboiler 45 is heated by nitrogen from the medium-pressure column. Another part of the air 17 directly supplies the medium-pressure column. The apparatus also produces gaseous nitrogen supplied from the medium-pressure column.

It should be apparent to those of ordinary skill in the art that an embodiment of the present invention can include other types of air separation apparatus instead of the apparatus discussed herein.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

What is claimed:

1. An air separation plant comprising:

a first air compressor and a second air compressor, wherein each are configured to receive air at substantially atmospheric pressure;

a first air purification unit and a second air purification unit;

a cold box having one or more medium-pressure air lines and one or more high-pressure air lines;

wherein the first air compressor is connected to the first air purification unit, wherein the first air purification unit is in fluid communication with the cold box;

wherein the second air compressor is connected to the second air purification unit, wherein the second air purification unit is in fluid communication with the cold box, wherein the first air compressor is configured to produce air at a first pressure and further configured to send all the air at the first pressure to the first purification unit, the first purification unit being connected to the one or more high-pressure air lines of the cold box;

wherein the second air compressor is configured to produce air at a second pressure and further configured to send all the air at the second pressure to the second air purification unit, the second air purification unit being connected to the one or more medium-pressure air lines of the cold box;

a means for modifying the operation of the second air compressor in order to increase the pressure of the air produced to a third pressure that is higher than the second pressure, the second pressure being lower than the first pressure; and a delivery side of the second air compressor being connected to the one or more high-pressure air lines of the cold box through the second purification unit so as to send air thereto at the third pressure.

2. The air separation plant as claimed in claim 1, such that at least one of the first air compressor or the second air compressor has two axial stages.

3. The air separation plant as claimed in claim 1, wherein the means for modifying operation of the second air compressor includes a device coupled to the second air compressor designed to have a variable speed of rotation.

4. The air separation plant as claimed in claim 3, wherein the device is selected from the group consisting of a steam turbine, and a high-speed motor.

5. The air separation plant as claimed in claim 1, wherein neither the first air compressor nor the second air compressor is configured to be driven by a stream turbine or an electric motor having an intake pressure substantially higher than the atmospheric pressure.

6. The air separation plant as claimed in claim 1, further comprising a third or more air compressor, such that the total number of air compressors is a multiple of 3 and/or the number of purification units is a multiple of 3 and/or the number of cold boxes is a multiple of 2.

7. The air separation plant as claimed in claim 1, further comprising an absence of compression means downstream of the first air compressor and upstream of the cold box; and an absence of compression means downstream of the second air compressor and upstream of the cold box.

8. The air separation plant as claimed in claim 1, wherein the delivery side of the first air compressor is connected solely to the inlet of the first air purification unit, such that the first air compressor is configured to send air only to the first air purification unit.

9. The air separation plant as claimed in claim 1, wherein the delivery side of the second air compressor is connected solely to the inlet of the second air purification unit, such that the second air compressor is configured to send air only to the second air purification unit.

10. An air separation process using a first air compressor and a second air compressor that are both supplied by air at atmospheric pressure, a first air purification unit, a second air purification unit, and a cold box, wherein, according to a first operating mode, the process includes the steps of:

sending high-pressure air from the first air compressor to the first air purification unit and from the first air purification unit to the cold box via one or more high-pressure lines; and sending medium-pressure air from the second air compressor to the second air purification unit and from the second air purification unit to the cold box, wherein, according to a second operating mode, the process includes the steps of:

modifying the second air compressor to produces. high-pressure air instead of producing medium-pressure air, the high pressure being higher than the medium pressure, the high-pressure air of the second compressor being purified in the second purification unit and sent to the cold box via the one or more high-pressure lines.

11. The air separation process as claimed in claim 10, wherein the first air compressor produces air between 3.5 bar and 10 bar absolute, and the second compressor produces air during the first operating mode at between 2.5 and 5 bar absolute, and during the second operating mode at between 3.5 bar and 10 bar absolute.

12. The air separation process as claimed in claim 10, wherein the first compressor is stopped during the second operating mode and the first purification unit is stopped during the second operating mode.

13. The air separation process as claimed in claim 10, wherein the first operating mode is the nominal mode, and the second operating mode is an emergency operating mode.

14. The air separation process as claimed in claim 10, wherein the first operating mode is the nominal operating mode for production by air separation, and the second operating mode is a reduced operating mode for production by air separation.

15. The air separation process as claimed in claim 10, wherein, according to the second operating mode, the high-pressure air of the second air compressor is sent into the second purification unit at high pressure.

16. The air separation process as claimed in claim 10, wherein all the air of the first air compressor is sent to the first air purification unit and all the air of the second air compressor is sent to the second air purification unit during both the first operating mode and the second operating mode.

17. The air separation process as claimed in claim 10, further comprising the step of monitoring a condition precedent and switching from the first operating mode to the second operating mode based upon the condition precedent, wherein the condition precedent is selected from the group consisting of flow rate of air coming from the first air compressor, flow rate of air coming from the first air purification unit, demand of product produced by the cold box, and combinations thereof.

18. An air separation process using a first air compressor, a second air compressor, and a third air compressor, a first air purification unit, a second air purification unit, a third air purification unit, a first high pressure valve, a second high pressure valve, a first medium pressure valve, a second medium pressure valve, a third medium pressure valve, a fourth medium pressure valve, a first cold box having a first medium pressure line and a first high pressure line, a second cold box having a second medium pressure line and a second high pressure line, wherein, according to a first operating mode, the first high pressure valve, the first medium pressure valve, and the third medium pressure valve are in an open position; the second high pressure valve, the second medium pressure valve, and the fourth medium pressure valve are in a closed position; and the process includes the steps of:

compressing a first air stream in the first air compressor to a first pressure $P_1$ to form a high pressure air stream;

purifying the high pressure air stream in the first air purification unit to form a purified high pressure air stream;

flowing the purified high pressure air stream through the first high pressure valve;

introducing a first portion of the purified high pressure air stream into the first cold box using the first high pressure line and;

introducing a second portion of the purified high pressure air stream into the second cold box using the first high pressure line;

compressing a second air stream in the second air compressor to a second pressure $P_2$ to form a first medium pressure air stream, wherein $P_2$ is less than $P_1$;

purifying the first medium pressure air strew the second air purification unit to form a first purified medium pressure air stream;

flowing the first purified medium pressure air stream through the first medium pressure valve;

introducing a first portion of the first purified medium pressure air stream into the first cold box using the first medium pressure line and;

introducing a second portion of the first purified medium pressure air stream into the second cold box using the second medium pressure line;

compressing a third air stream in the third air compressor to a second pressure $P_2$ to form a second medium pressure air stream;

purifying the second medium pressure air stream in the third air purification unit to form a second purified medium pressure air stream;

flowing the second purified medium pressure air stream through the third medium pressure valve;

introducing a first portion of the second purified medium pressure air stream into the first cold box using the first medium pressure line and;

introducing a second portion of the second purified medium pressure air stream into the second cold box using the second medium pressure line;

introducing the purified medium pressure air stream into the medium pressure cold box under conditions effective to separate the purified medium pressure air stream into a second nitrogen rich stream and a second oxygen rich stream;

wherein, according to a second operating mode, the first high pressure valve and the first medium pressure valve are switched to a closed position, such that first high pressure line and the second high pressure line are riot in fluid communication with the first air purification unit; the second medium pressure valve is switched to an open position, and the process includes the steps of:

modifying the second air compressor such that the second air compressor is configured to produce a gas stream having a third pressure of $P_3$, wherein $P_3$ is greater than $P_2$ and equal to or less than $P_1$;

compressing the second air stream in the second air compressor to the third pressure $P_3$ to form an alternate high pressure air stream;

purifying the alternate high pressure air stream in the second air purification unit to form an alternate purified high pressure air stream;

flowing the alternate purified high pressure air stream through the second medium pressure valve;

introducing a first portion of the alternate purified high pressure air stream into the first cold box using the first high pressure line;

introducing a second portion of the alternate purified high pressure air stream into the second cold box using the second high pressure line;

compressing the third air stream in the third air compressor to the second pressure $P_2$ to form the second medium pressure air stream;

purifying the second medium pressure air stream in the third air purification unit to form the second purified medium pressure air stream;

flowing the second purified medium pressure air stream through the third medium pressure valve;

introducing the first portion of the second purified medium pressure air stream into the first cold box using the first medium pressure line; and introducing the second portion of the second purified medium pressure air stream into the second cold box using the second medium pressure line.

* * * * *